US009137596B2

(12) United States Patent
Burgett et al.

(10) Patent No.: US 9,137,596 B2
(45) Date of Patent: Sep. 15, 2015

(54) SPLITTER FOR EARPHONES AND HEADPHONES

(71) Applicant: Harman International Industries, Incorporated, Stamford, CT (US)

(72) Inventors: Seth D. Burgett, Glen Carbon, IL (US); Aaron Gorga, St. Louis, MO (US); Effrosini A. Karayiannis, St. Louis, MO (US)

(73) Assignee: Harman International Industries, Inc., Stamford, CT (US)

( * ) Notice: Subject to any disclaimer, the term of this patent is extended or adjusted under 35 U.S.C. 154(b) by 0 days.

(21) Appl. No.: 14/067,664

(22) Filed: Oct. 30, 2013

(65) Prior Publication Data

US 2014/0119590 A1 May 1, 2014

Related U.S. Application Data

(60) Provisional application No. 61/720,392, filed on Oct. 30, 2012.

(51) Int. Cl.
*H04R 1/10* (2006.01)

(52) U.S. Cl.
CPC ..... *H04R 1/1033* (2013.01)

(58) Field of Classification Search
CPC .... H04R 1/10; H04R 2205/022; H04R 1/105; H04R 5/0335; H04R 2201/10
USPC ..... 381/370, 374, 379, 383–384
See application file for complete search history.

(56) References Cited

U.S. PATENT DOCUMENTS

| | | | | |
|---|---|---|---|---|
| D654,057 | S | 2/2012 | Burgett et al. | |
| 8,116,503 | B2 * | 2/2012 | Daniels et al. | 381/384 |
| 8,204,268 | B2 * | 6/2012 | Li | 381/384 |
| 8,218,808 | B2 * | 7/2012 | Xu | 381/384 |
| D695,718 | S | 12/2013 | Burgett et al. | |
| D695,719 | S | 12/2013 | Burgett et al. | |
| D696,230 | S | 12/2013 | Burgett et al. | |
| D699,185 | S | 2/2014 | Burgett et al. | |
| D699,213 | S | 2/2014 | Burgett et al. | |
| 2013/0108098 | A1 * | 5/2013 | Qin | 381/384 |
| 2013/0188804 | A1 | 7/2013 | Burgett | |
| 2013/0336495 | A1 | 12/2013 | Burgett et al. | |

* cited by examiner

*Primary Examiner* — Suhan Ni
(74) *Attorney, Agent, or Firm* — Brooks Kushman P.C.

(57) ABSTRACT

A set of earphones includes a splitter having a splitter body, having first and second ends. A signal wire extends from the first end of the splitter. Left and right earphone wires extending from the second end of the splitter. A sleeve projecting from the second end of the splitter, surrounding the left and right earphone wires. A cinch is slidably mounted on the left and right earphone wires, a portion of the cinch is adapted to fit in the sleeve projecting from the second end of the elongate body, for stowing the cinch when not in use.

4 Claims, 1 Drawing Sheet

SPLITTER FOR EARPHONES AND HEADPHONES

CROSS-REFERENCE TO RELATED APPLICATIONS

This application claims priority to U.S. Provisional Patent Application Ser. No. 61/720,392, filed Oct. 30, 2012. The entire disclosure of the above-referenced application is incorporated herein.

FIELD

This invention relates to earphones and headphones, and in particular to splitters for earphones and headphones.

BACKGROUND

This section provides background information related to the present disclosure which is not necessarily prior art.

Most wired earphones and headphones include a splitter for taking a single signal wire that is connected to a signal source, such as an mp3 player or telephone, and connecting it to two (left and right) speaker wires extending to the earphone or headphones.

SUMMARY

This section provides a general summary of the disclosure, and is not a comprehensive disclosure of its full scope or all of its features.

Embodiments of the present invention provides earphones or headphones (hereinafter earphones) with a better, more attractive splitter, that can provide better wire management. Generally, the earphone includes a splitter having first and second ends. A signal wire is connected to the first end of the splitter for communicating a signal from a signal source, such as an mp3 player or phone. Left and right speaker wires extend from the second end of the splitter. The splitter comprises an elongate body having a sleeve projecting from the second end of the splitter, surrounding the left and right earphone wires. A cinch is slidably mounted on the left and right earphone wires. A portion of the cinch adapted to fit in the sleeve projecting from the second end of the elongate body. The user can slide the cinch on the left and right speaker wires to cinch them together selectively along their lengths to adjust the fit. When not in use, the cinch can be stowed in the sleeve of the second end of the splitter.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 5:
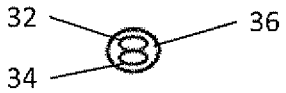
FIG. 5 is a top plan view thereof.
Figure 2:
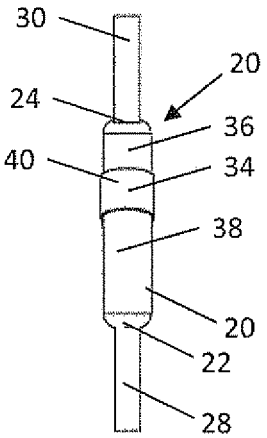
FIG. 2 is a rear elevation view thereof.
Figure 3:
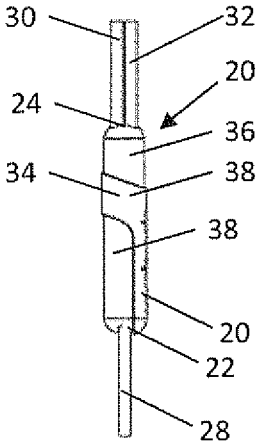
FIG. 3 is a left-side elevation view thereof.
Figure 1:
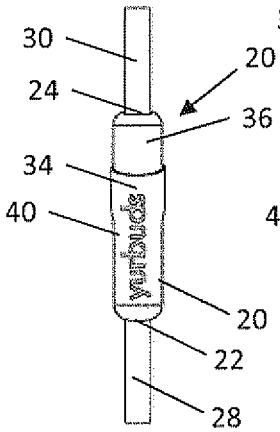
FIG. 1 is a front elevation view of a splitter constructed according to the principles of this invention.
Figure 4:
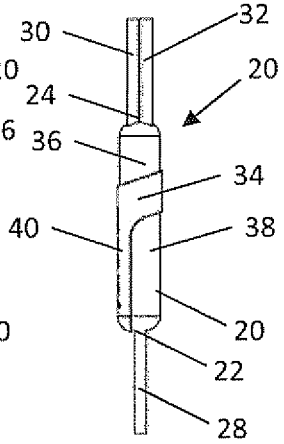
FIG. 4 is a right-side elevation view thereof.
Figure 6:
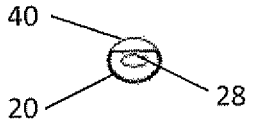
FIG. 6 is a bottom plan view thereof.

Example embodiments will now be described more fully with reference to the accompanying drawings.

A splitter for an earphone system, in accordance with the principles of this invention is indicated generally as 20 in the Figures. Generally, the splitter 20 comprises an elongate body 22 having first and second ends 24 and 26. A signal wire 28 is connected to the first end 24 of the splitter 20 for communicating a signal from a signal source, such as an mp3 player or phone. Left and right speaker wires 30 and 32 extend from the second end 26 of the splitter 20.

The splitter 20 has a sleeve 34 projecting from the second 26 end of the splitter that surrounds the left and right speaker wires 30 and 32. A cinch 36 is slidably mounted on the left and right speaker wires 30 and 32. A portion of the cinch 36 is adapted to fit in the sleeve 34 projecting from the second end 26 of the elongate body 22. The user can slide the cinch 36 upwardly and downwardly on the left and right speaker wires 30 and 32 to cinch them together selectively along their lengths to adjust the fit of the earphones. When not in use, the cinch 36 can be stowed in the sleeve 34 of the second end 26 of the splitter 20.

In this preferred embodiment, the elongate body 22 preferably has a generally elliptical cross-section, and the sleeve 34 projecting from the second end 26 of the elongate body 22, likewise has a generally elliptical cross-section. In this preferred embodiment the end of the sleeve 34 on the second end 26 of the elongate body 22 is at a non-perpendicular angle with respect to the longitudinal axis of the sleeve, and more preferably at an angle with respect to the minor axis of the generally elliptical cross section.

In this preferred embodiment, elongate body 22 comprises a core 38 of a resilient material, and a shell 40 of a more rigid material partially covering portions of the core like an exoskeleton. The sleeve 34 on the second end 26 of the elongate body 22 is preferably part of the shell 40 of the more rigid material. The cinch 36 is preferably made of the same resilient material as the core 38, which gives the cinch a comfortable resilient, rubbery feel, and which can lightly frictionally engage the speaker wires 30 and 32, so that the cinch 36 resists sliding unless purposefully adjusted by the user.

In operation the earphones are used like conventional earphones with the splitter operating to provide audio signals to the left and right speaker wires. However, the user can adjust the fit of the earphones, by sliding the cinch 36, by engaging a portion of the cinch that projects from the sleeve up the speaker wires to a point under the chin that is most comfortable for the user. The material of the cinch frictionally engages the wire to retain the cinch in the desired position. When the cinch is not needed, it can simply be slide down the wire and partially into the sleeve 34, so that the splitter has a nice neat look, and the cinch does not contribute to the tangling of the wires.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A set of earphones, comprising:

a splitter having first and second ends;

a signal wire extending from the first end of the splitter;

left and right earphone wires extending from the second end of the splitter;

the splitter comprising an elongate body having a sleeve having a generally elliptical cross section projecting from the second end of the splitter, surrounding the left and right earphone wires; the end of the sleeve on the second end of the elongate body being at a non-perpendicular angle with respect to the axis of the sleeve and the minor axis of the generally elliptical cross section; and a cinch slidably mounted on the left and right earphone wires, a portion of the cinch adapted to fit in the sleeve projecting from the second end of the elongate body.

2. The set of the earphones according to claim 1 wherein the elongate body comprises a core of a resilient material, and a shell of a more rigid material partially covering portions of the core.

3. The set of earphones according to claim 2, wherein the sleeve on the second end of the elongate body is part of the shell of the more rigid material.

4. The set of earphones according to claim 3, wherein the cinch is made of the same resilient material as the core.

* * * * *